United States Patent [19]

Hellsten

[11] Patent Number: 4,659,332

[45] Date of Patent: Apr. 21, 1987

[54] PROCESS FOR DRY-CLEANING TEXTILES AND MICROEMULSION DRY CLEANING COMPOSITION FOR THE USE THEREIN

[75] Inventor: Karl M. E. Hellsten, Odsmal, Sweden

[73] Assignee: Berol Kemi AB, Stenungsund, Sweden

[21] Appl. No.: 419,664

[22] Filed: Sep. 20, 1982

[30] Foreign Application Priority Data

Sep. 21, 1981 [SE] Sweden ..... 8105555-0

[51] Int. Cl.[4] ..... C11D 1/22; C11D 1/831; C11D 3/44; D06L 1/04

[52] U.S. Cl. ..... 8/142; 252/170; 252/171; 252/174.21; 252/174.22; 252/559; 252/DIG. 14

[58] Field of Search ..... 8/142; 252/559, 170, 252/171

[56] References Cited

U.S. PATENT DOCUMENTS

| | | | |
|---|---|---|---|
| 3,222,286 | 12/1965 | Barnes | 252/559 |
| 3,272,754 | 9/1966 | Jaccard | 252/559 |
| 4,199,482 | 4/1980 | Renaud et al. | 252/559 |
| 4,378,968 | 4/1983 | Peignier | 8/142 |

FOREIGN PATENT DOCUMENTS

| | | | |
|---|---|---|---|
| 2214781 | 9/1974 | France | 8/142 |
| WO82/02218 | 7/1982 | PCT Int'l Appl. | 8/137 |
| 992861 | 5/1965 | United Kingdom | 252/559 |

OTHER PUBLICATIONS

Prince, ed., *Microemulsions*, Academic Press, Inc., N.Y. 1977, pp. 71–73 and 78–87 and 4–7, 16–19, 30, 31, pp. 92, 93.

*Primary Examiner*—Dennis L. Albrecht

[57] ABSTRACT

Textiles are washed in a fluid dry cleaning composition in the form of a microemulsion of an aqueous phase in perchloroethylene, comprising as the principal ingredients:

| | Percent by Weight |
|---|---|
| Perchloroethylene | 65–93.8 |
| Emulsifier composed of a mixture of (a) a calcium salt of an alkyl-aryl sulphonic acid with a total of 14 to 22 carbon atoms; and (b) a non-ionic surface-active hydrophobic alkylene oxide adduct, in which the alkylene oxide is in the form of ethylene oxide or a mixture of ethylene oxide and alkylene oxide with 3 to 4 carbon atoms, and in which the hydrophobic part of the adduct has from 8 to 30 carbon atoms, in a weight ratio (a):(b) within the range 1:4 to 3:1 | 2–6 |
| Aliphatic monoalcohol having from 4 to 10 carbon atoms | 0.2–4 |
| Water the ratio of the weight of the water to the weight of the emulsifier being in excess of 2:1. | 4–20 |

10 Claims, No Drawings

PROCESS FOR DRY-CLEANING TEXTILES AND MICROEMULSION DRY CLEANING COMPOSITION FOR THE USE THEREIN

The dry-cleaning of textiles using an organic solvent to remove lipophilic dirt such as oils and fat is now in general use throughout the world. The organic solvent may be combined with an aqueous solution of an emulsifier and a solubilizing agent, which is capable of removing hydrophilic dirt, such as salts and silicate particles. A conventional dry-cleaning fluid is based on perchloroethylene as the organic solvent, and also contains 0.2 to 1 percent by weight of an emulsifier and a solubilizing agent and 0.2 to 1 percent by weight of water in order to improve removal of hydrophilic dirt.

An article published in "Ytkemiska Institutet, Verksamhetsberattelse 1978–1979, Page 10" (Annual Report of the Institute of Surface Chemistry for 1978–1979, Page 10) also proposes the use in dry-cleaning of a perchloroethylene-base dry cleaning fluid containing considerably in excess of 1 percent water by weight, and in the form of a microemulsion. Non-ionic surface-active compounds are used as the emulsifier, optionally in combination with small quantities of anionic surface-active compounds. The principal advantage of a microemulsion is that it is thermodynamically stable, unlike an ordinary emulsion, i.e. that the dispersed liquid phase, water and organic solvent, will not settle out on standing, but will remain dispersed, even without stirring. In certain cases a microemulsion will also produce a distinctly better cleaning effect.

One disadvantage, however, is that the emulsifier must be added in a proportion by weight which corresponds to that of the water, in order to produce a microemulsion. Furthermore, the microemulsion is usually only stable within a rather limited temperature range. For these reasons, microemulsions of this type, with water contents within the range of from 5 to 15 percent by weight, have failed to find practical application in the washing of textiles, in spite of the fact that dry cleaning fluids of this type have exhibited an extremely good cleaning effect, especially on very dirty heavily soiled garments, such as working clothes.

Dry-cleaning fluids with a high water content are also described in Swedish Pat. No. 320,753. In this case the dry-cleaning fluid contains as the emulsifier a mixture of an organic amine salt of an alkyl aryl sulphonic acid, and as a solubilizing agent compounds with relatively high boiling points having hydroxy groups, such as alkylene glycols and their esters. The presence of such emulsifiers and solubilizing agents has been found to impart a sticky feel and an unpleasant odor to the cleaned textile materials. Consequently, dry-cleaning fluids in accordance with Swedish Pat. No. 320,753 have found only limited application, and then only in compositions with low levels of emulsifiers and solubilizing agents, i.e. less than 1% by weight of the total weight of the dry-cleaning fluid.

In accordance with the present invention a dry-cleaning fluid which does not impart an unpleasant odor and stickiness to the textiles cleaned therewith is provided, as a microemulsion with a weight ratio of water to emulsifier of more than 2:1, which remains stable over a comparatively wide range of temperatures. The dry-cleaning fluid comprises:

| | Percent by Weight | Preferred Range |
|---|---|---|
| Perchloroethylene | 65 to 93.8 | 65 to 90.6 |
| Emulsifier composed of a mixture of (a) a calcium salt of an alkyl-aryl sulphonic acid with a total of 14 to 22 carbon atoms; and (b) a non-ionic surface-active hydrophobic alkylene oxide adduct, in which the alkylene oxide is in the form of ethylene oxide or a mixture of ethylene oxide and alkylene oxide with 3 to 4 carbon atoms, and in which the hydrophobic part of the adduct has from 8 to 30 carbon atoms, in a weight ratio (a):(b) within the range 1:4 to 3:1 | 2 to 6 | 3 to 5 |
| Aliphatic monoalcohol having from 4 to 10 carbon atoms | 0.2 to 4 | 0.4 to 2 |
| Water the ratio of the weight of the water to the weight of the emulsifier being in excess of 2:1. | 4 to 20 | 6 to 15 |

The aliphatic monoalcohol serves as a solubilizing agent. If desired, other conventional additives used in dry cleaning compositions, such as dirt removers, salts, optical whitening agents, and small quantities of other hydrocarbon-base solvents, may also be included.

The dry cleaning fluids in accordance with the present invention give a considerably better cleaning effect than conventional dry-cleaning fluids since they remove both lipophilic (oil-soluble) and hydrophilic (water-soluble) dirt. It is possible in this way to avoid additional washing stages using aqueous washing compositions. A special advantage of the dry-cleaning fluids in accordance with the present invention is their outstanding ability to hold the dirt in dispersed form. The redeposition of such dirt onto the textiles occurs, if at all, only to a very limited extent. The so-called "greying" of the textiles is very low.

The dry-cleaning process using the dry cleaning composition in accordance with the invention is best followed by one or several rinses in perchloroethylene. Small quantities of an emulsifier and/or solubilizing agent in an amount of 0.2 to 2 percent by weight can be added, in order to prevent the residue of the microemulsion from being deposited, and forming an ordinary emulsion. This emulsifier and solubilizing agent should preferably be the same emulsifier and solubilizing agent used in the microemulsion in accordance with the invention.

The dry-cleaning compositions of the invention can be used for dry-cleaning textile materials of all kinds, suitable for cleaning in perchloroethylene, including both woven and nonwoven materials made of natural or synthetic fibers or mixtures thereof, such as, for example, rayon, acetate rayon, cellulose acetate-propionate, cellulose acetate-butyrate, polyvinyl chloride, polypropylene, polyethylene, polyacrylonitrile, polyesters such as ethylene glycolterephthalic acid polymers, cotton, linen, jute, wool, mohair, glass, potassium titanate, bast, bagasse, and fur fibers of various kinds such as beaver, rabbit, seal, muskrat, otter, mink, caracul, lamb and squirrel.

The textile materials can take any form, including nonwoven materials such as felts, bats and mats; woven materials such as fabrics, cloth, carpets, rugs and upholstery; synthetic fur materials; curtains, and covering materials of all kinds.

The calcium salt of the alkyl-aryl-sulphonic acid which is present in the emulsifier is insoluble in water but is soluble in the aliphatic monoalcohol. The preferred alkyl aryl sulphonic acid salts are the salts of alkylbenzene sulphonic acids in which the alkyl group contains from about 8 to about 16 carbon atoms and having the general formula:

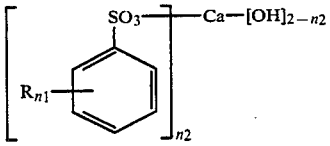

wherein

R is a straight or branched chain alkyl group having from eight to about sixteen carbon atoms;

$n_1$ is 1, 2 or 3;

$n_2$ is 1 or 2.

An example of a suitable calcium alkylbenzene sulphonate is calcium dodecyl benzene sulphonate.

Another example are the calcium phenyl polypropylene sulfonates characterized by the branched chain structure of polypropylene and tertiary alkyl carbon at the benzene ring, and having the following general structure:

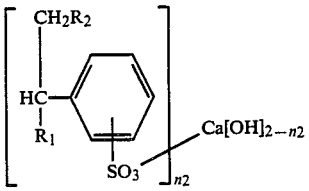

wherein:

$R_1$ and $R_2$ are alkyl, of the type formula $C_nH_{2n+1}$, and at least one R is a polypropylene group, the whole alkyl group containing preferably 12 to 15 carbon atoms. These are known compounds, whose preparation and properties are set forth in U.S. Pat. No. 2,477,383, to Lewis, issued July 26, 1949.

Other water-soluble alkyl aromatic sulfonic acids include those prepared by alkylating benzene or naphthalene with a kerosene fraction, followed by sulfonation to aromatic sulfonic acids, such as sodium keryl benzene sulfonate.

The nonionic surface-active hydrophobic alkylene oxide adducts have the following general formula:

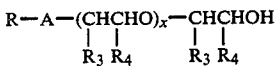

where R is hydrogen or a straight or branched chain saturated or unsaturated hydrocarbon group having from 8 to 30 carbon atoms or an aralkyl group having a straight or branched chain saturated or unsaturated hydrocarbon group or from 6 to 24 carbon atoms attached to the aryl nucleus, and attached to A through the aryl nucleus. A is selected from the group consisting of ethereal oxygen and carboxylic ester groups, $R_3$ and $R_4$ are hydrogen or methyl, and x is a number from 2 to 100 and preferably from 2 to 30. R can, for example, be a straight or branched chain alkyl group such as octyl, nonyl, decyl, lauryl, myristyl, cetyl, palmityl, stearyl, or an alkylaryl group such as octylphenyl, nonylphenyl, decylphenyl, stearylphenyl, etc. In this formula, OH could also be replaced by the group $O(C_3H_6O)_mH$, where m is a number ranging from 1 to 10. Examples of such nonionic surfactants are such as have been obtained by adding ethylene oxide, propylene oxide or butylene oxide to the above mentioned alcohols or phenols.

Among the nonionic surfactants, a preferred class are the alkoxylated alkyl phenols, which have the following general formula:

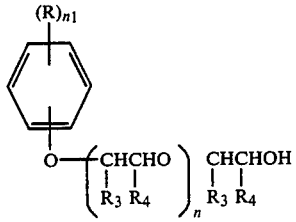

in which R is an alkyl group totalling from 6 to 29 carbon atoms, $n_1$, $R_3$ and $R_4$ are as above, the oxyalkylene groups are derived from ethylene oxide and/or propylene oxide, in which the number of units derived from ethylene oxide is greater than 30% of the total number of units derived from alkylene oxide, and n represents a number from 2 to 50 and preferably from 2 to 30. Examples of such compounds are nonyl phenol to which 2 to 20 moles of ethylene oxide per mole of nonyl phenol have been added, and tributyl phenol or dinonyl phenol to which 3 to 30 moles or 6 to 50 moles respectively, of ethylene oxide per mole of substituted phenol have been added.

It has been found to be advantageous to use mixtures of non-ionic surface-active alkylene oxide adducts. Such mixtures are best made up of a non-ionic alkylene oxide adduct which is insoluble in water but water-dispersible, and a non-ionic alkylene oxide adduct which is water-soluble. The expression "insoluble in water but water-dispersible" means that the product in question will form an emulsion when diluted with water at a temperature of 18° C. to a concentration of 1%. The use of mixtures of non-ionic surface-active alkylene oxide adducts enables the range of temperatures within which the microemulsion can be produced to be extended and/or shifted.

The aliphatic monoalcohol that serves as a solubilizing agent is essential if the microemulsions are to have a high water-absorbing capacity. An aliphatic monoalcohol having from 4 to 10 carbon atoms in the alkyl chain in an amount of 0.2 to 3 and preferably 0.4 to 2 percent by weight imparts to the dry-cleaning fluid a well-balanced hydrophilic lipophilic character. Of the available monoalcohols, butanol and butanol blends in which butanol comprises at least 50 percent by weight are preferred. It has also been found desirable that the monoalcohol dissolve the anionic surface-active compound.

The ratio of the weight of the emulsifier to the weight of the monoalkanol preferably is within the range from 5:1 to 2:1.

Examples of suitable aliphatic monoalcohols are n-butanol, iso-butanol, tert-butanol, sec-butanol, n-pentanol, iso pentanol, tert-pentanol, n-hexanol, isohexanol, tert-hexanol; n-heptanol, isoheptanol, 2,2-dimethylpentanol; n-octanol, isooctanol, 2-ethyl-hexanol; nonanol, isononanol, and n-decanol.

The compositions of the invention are easily prepared by simple mixing of the ingredients, with adequate stirring to form a microemulsion of the aqueous phase (composed of water, emulsifier, and monoalkanol, plus any other water-soluble or hydrophilic ingredients) in perchloroethylene.

Preferred embodiments of the invention are represented by the following Examples:

EXAMPLES 1 TO 5

Dry-cleaning compositions having the formulation shown in the following Table I were prepared.

TABLE I

| | Parts by Weight | | | | | | |
|---|---|---|---|---|---|---|---|
| | Example No. | | | | | Controls | |
| Ingredients | 1 | 2 | 3 | 4 | 5 | A | B |
| Perchloroethylene | 95 | 95 | 95 | 95 | 95 | 95 | 95 |
| Ca dodecyl benzene-sulphonate | 1.65 | 1.5 | 1.38 | 1.45 | 1.83 | — | 1.83 |
| Na lauryl sulphate | — | — | — | — | — | 0.03 | — |
| Nonyl phenol + 8 moles EO | — | 0.5 | — | — | — | 4.97 | — |
| Blend of nonyl phenol + (6, 16, 20) EO | 2.05 | — | — | — | — | — | 2.77 |
| Nonyl phenol + 20 EO | — | 1.5 | — | 0.12 | 1.12 | — | — |
| Nonyl phenol + 8 PO + 20 EO | — | — | 2.25 | — | 0.88 | — | — |
| Castor oil + 40 EO | — | — | — | 2.55 | — | — | — |
| n-butanol | 1.05 | 1.5 | 1.37 | 0.93 | 1.17 | — | 0.20 |
| 2-ethyl-hexanol | 0.25 | — | — | — | — | — | — |
| water | 10 | 10 | 10 | 10 | 8 | 2 | 2 |

EO = Ethylene oxide
PO = Propylene oxide

The compositions were diluted with water at 20°, 25° and 30° C., and the total amount of water that had been added when the microemulsion changed to an ordinary emulsion was noted (severe turbidity). The following results were obtained:

| | Total % water added to the composition at turbidity point | | |
|---|---|---|---|
| Example No. | 20° C. | 25° C. | 30° C. |
| 1 | 15.0 | 18.8 | 18.8 |
| 2 | 16.0 | 19.0 | 17.2 |
| 3 | 13.0 | 11.5 | 9.8 |
| 4 | 9.0 | 8.6 | 8.0 |
| 5 | 8.2 | * | * |
| A | 4.2 | 4.2 | 4.5 |
| B | 3.2 | * | * |

*not recorded

Examples 1 to 5 form microemulsions in accordance with the invention, i.e., they contain an amount of water that exceeds by 100% the amount of emulsifier. In the most favorable cases, the ratio of the weight of the water to the weight of the emulsifier is considerably greater than 3:1. Controls A and B do not form microemulsions in accordance with the invention, because in Control A there is no calcium dodecyl benzene sulphonate and no alkanol, and in Control B the amount of alkanol is too low.

Dry-cleaning with a dry-cleaning composition similar to Example 2 was performed at a temperature of 25° C. in a Terg-O-Tometer laboratory-standard washing machine. The material to be washed was in the form either of artificially soiled 65/35 polyester/cotton fabric supplied by Testfabrics of the USA together with white unsoiled 65/35 polyester/cotton fabric, or of artificially soiled cotton fabric supplied by Waschereiforschung of Krefeld together with white unsoiled cotton fabric. Details of the steps in the dry-cleaning process and of the cleaning and rinsing fluids appear in the following Table II.

TABLE II

| | Cleaning and Rinsing Fluids | | |
|---|---|---|---|
| Washing process | According to the invention | Comparison I | Comparison II |
| Wash 30 minutes | 79% Perchloroethylene 6% Emulsifier + alkanol[1] from Example 2 15% Water | 100% Perchloroethylene | 90% Perchloroethylene 6% Emulsifier according to Example 5 (no alkanol) 4% Water |
| Rinse I 5 minutes | 99.5% Perchloroethylene 0.5% Emulsifier + alkanol[1] from Example 2 | 100% Perchloroethylene | 99.5% Perchloroethylene 0.5% Emulsifier according to Control A |
| Rinse II 5 minutes | 100% Perchloroethylene | 100% Perchloroethylene | 100% Perchloroethylene |

[1]alkanol:emulsifier weight ratio 1.5:3.5

When the dry-cleaning process was complete, the cleaning effect was determined, using a photometer to measure the reflectance and to calculate the percentage of soil removed by the dry-cleaning and the percentage of greying in relation to absolutely white fabric. The following results were obtained.

TABLE III

| | % soil removed by washing | | % greying | |
|---|---|---|---|---|
| | Polyester/Cotton | Cotton | Polyester/Cotton | Cotton |
| According to the invention | 83.9 | 87.5 | 2.0 | 3.0 |
| Comparison I | 68.2 | 84.5 | 5.6 | 6.0 |
| Comparison II | 42.0 | 81.7 | 5.9 | 14.0 |

The results show that the dry-cleaning fluid in accordance with the present invention removes pigmented soil considerably more effectively than the comparative dry-cleaning fluids. Greying of the unsoiled fabric is also surprisingly low, when the composition of the invention is used.

Having regard to the foregoing disclosure the following is claimed as the inventive and patentable embodiments thereof:

1. A fluid dry cleaning composition in the form of a microemulsion of an aqueous phase comprising emulsifier, aliphatic monoalcohol and water in perchloroethylene, comprising as the principal ingredients:

| | Percent by Weight |
|---|---|
| Perchloroethylene | 65–93.8 |
| Emulsifier composed of | 2–6 |
| (a) a calcium salt of an alkyl-aryl sulphonic acid with a total of 14 to 22 carbon atoms; and | |
| (b) a non-ionic surface-active hydrophobic alkylene oxide adduct, in which the alkylene oxide is in the form of ethylene oxide or a mixture of ethylene oxide and alkylene oxide having 3 to 4 carbon atoms, and in which the hydrophobic part of the | |

-continued

| | Percent by Weight |
|---|---|
| adduct has from 8 to 30 carbon atoms; in a weight ratio (a):(b) within the range 1:4 to 3:1 | |
| Aliphatic monoalcohol having from 4 to 10 carbon atoms | 0.2–4 |
| Water | 4–20 |
| the ratio of the weight of water to the weight of emulsifier being in excess of 2:1. | |

2. A fluid dry cleaning composition according to claim 1, in which the monoalcohol comprises at least 50% by weight butanol.

3. A fluid dry cleaning composition according to claim 1 in which the alkylene oxide adduct has the formula

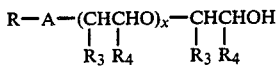

where R is hydrogen or a straight or branched chain saturated or unsaturated hydrocarbon group having from 8 to 30 carbon atoms or an aralkyl group having a straight or branched chain saturated or unsaturated hydrocarbon group or from 6 to 24 carbon atoms attached to the aryl nucleus, and attached to A through the aryl nucleus; A is selected from the group consisting of ethereal oxygen and carboxylic ester groups; $R_3$ and $R_4$ are hydrogen or methyl; and x is a number from 2 to 100.

4. A fluid dry cleaning composition according to claim 1, in which the fluid dry cleaning composition comprises between 65 and 93.8 percent by weight perchloroethylene, between 3 and 5 percent by weight emulsifier, between 0.4 and 2 percent by weight monoalcohol and between 6 and 15 percent by weight water.

5. A fluid dry cleaning composition according to claim 1, in which the alkylene oxide adduct comprises at least two adducts, one of which is insoluble in water but water-dispersible, and the other of which is water-soluble.

6. A fluid dry cleaning composition according to claim 1, in which the alkylene oxide adduct has the formula:

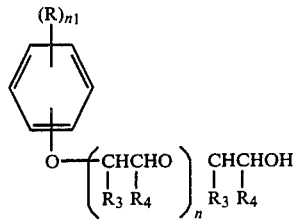

in which R is an alkyl group having from 6 to 29 carbon atoms, $R_3$ and $R_4$ are hydrogen or methyl; n represents a number from 2 to 50, and $n_1$ is 1, 2 or 3.

7. A fluid dry cleaning composition according to claim 1, in which the alkyl aryl sulphonic acid salt has the formula:

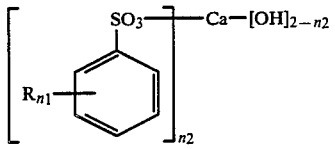

wherein

R is a straight or branched chain alkyl group having from eight to about sixteen carbon atoms;

$n_1$ is 1, 2 or 3; and $n_2$ is 1 or 2.

8. A process for dry-cleaning textiles, which comprises dry cleaning the textile with a dry cleaning composition according to claim 1.

9. A process for dry-cleaning textiles according to claim 8, in which the dry cleaning composition contains between 65 and 93.8 percent by weight of perchloroethylene, between 3 and 5 percent by weight of emulsifier, between 0.4 and 2 percent by weight of monoalcohol, and between 6 and 15 percent by weight of water.

10. A process for dry-cleaning textiles according to claim 8, in which the alkylene oxide adduct comprises at least two adducts, one of which is insoluble in water but water-dispersible, and the other of which is water-soluble.

* * * * *